United States Patent [19]

Shaheen

[11] Patent Number: 4,505,447

[45] Date of Patent: Mar. 19, 1985

[54] WALL SUPPORT

[76] Inventor: Louis R. Shaheen, 534 W. Moreland Ave., Horsham, Pa. 19044

[21] Appl. No.: 457,100

[22] Filed: Jan. 10, 1983

Related U.S. Application Data

[63] Continuation of Ser. No. 201,665, Oct. 27, 1980, abandoned.

[51] Int. Cl.[3] ..... A47B 96/06

[52] U.S. Cl. ..... 248/216.1; 248/313

[58] Field of Search ..... 248/216.1, 312.1, 313, 248/311.2, 220.2, 220.3, 220.5, 221.2, 217.2, DIG. 5, 217.1, 216.4; 108/109

[56] References Cited

U.S. PATENT DOCUMENTS

| | | | |
|---|---|---|---|
| 541,114 | 6/1895 | Nolan | 248/220.2 |
| 2,266,294 | 12/1941 | Allderdice | 248/312.1 |
| 3,091,424 | 5/1963 | Yegge | 248/312.1 |
| 3,193,225 | 7/1965 | Terlinde | 248/221.2 |
| 3,193,234 | 7/1965 | Thurman et al. | 248/313 |
| 3,219,302 | 11/1965 | Smith | 248/DIG. 5 |
| 3,376,911 | 4/1968 | Henning | 248/216.1 |
| 3,392,949 | 7/1968 | Meyer | 248/220.5 |
| 3,537,671 | 11/1970 | Wenthe | 248/222.2 |
| 4,071,976 | 2/1978 | Chernewski | 248/312.1 |
| 4,300,745 | 11/1981 | Peterson | 248/217.1 |
| 4,422,608 | 12/1983 | Hogg | 248/216.4 |

FOREIGN PATENT DOCUMENTS

| | | | |
|---|---|---|---|
| 0215100 | 10/1960 | Austria | 108/109 |
| 0037392 | 11/1921 | Norway | 248/217.2 |

*Primary Examiner*—William H. Schultz
*Assistant Examiner*—Ramon O. Ramirez
*Attorney, Agent, or Firm*—Caesar, Rivise, Bernstein & Cohen, Ltd.

[57] ABSTRACT

A support for mounting an object on a vertically disposed hollow wall having an exterior surface and an interior surface spaced from each other by a predetermined distance. The support comprising a body, an intermediate leg and a wall piercing member. The body is an elongated planar member having a first and second end. The leg is a planar member approximately equal in length to said predetermined distance and is connected to the first end of said body perpendicularly to the plane of the body. The piercing member is connected to said leg portion parallel to the plane of said body means and is arranged to pierce through the wall portion connecting said surfaces, whereupon, when said support is rotated downward with respect to said wall portion, the piercing member abuts said interior surface of the wall with the body abutting the exterior surface and the leg resting on the wall material contiguous with the opening produced by the piercing action. In one embodiment, the support includes a ledge and a slidable clamp to mount a container on the wall. In another embodiment, the support forms a part of a shelf bracket.

9 Claims, 9 Drawing Figures

FIG. 1
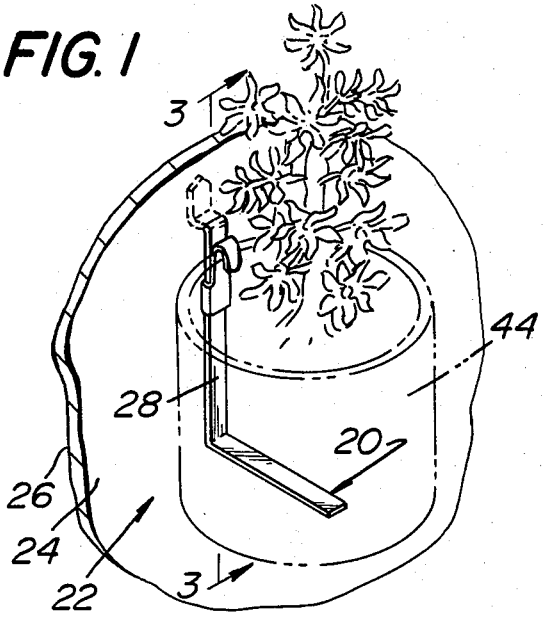
FIG. 2
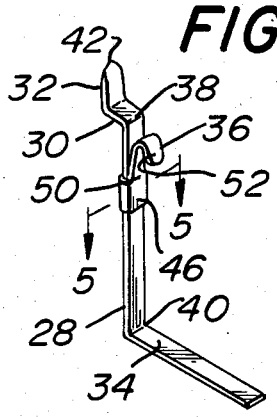
FIG. 3
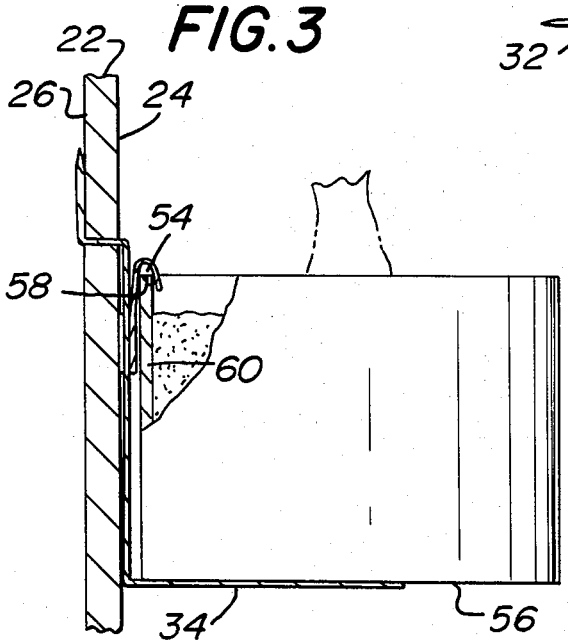
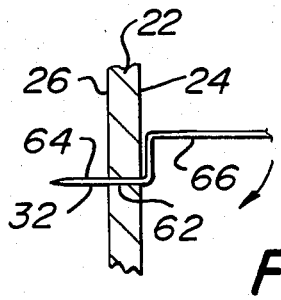
FIG. 4
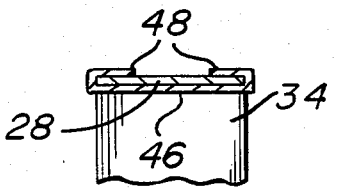
FIG. 5

WALL SUPPORT

This application is a continuation of application Ser. No. 201,665, filed on Oct. 27, 1980, now abandoned.

This invention relates generally to supports and more particularly to supports for use on vertical surfaces such as walls, etc.

Various devices are commercially available for mounting and securing objects onto vertical surfaces such as walls, doors, etc. Examples of such devices are brackets, standards, ledges, etc. The securement of such devices on hollow type walls, e.g., gypsum board, paneling, etc., is usually accomplished by the use of conventional fasteners, such as wall anchors, toggle bolts, screw anchors, etc. The use of such fasteners is time consuming and relatively expensive.

Accordingly, it is a general object of the instant invention to provide a support for mounting an object on the wall which does not require the use of conventional fastening devices.

It is a further object of the instant to provide a support which is particularly suited for self-mounting on hollow wall sections, such as plaster board, paneling, etc.

It is still a further object of the instant invention to provide a self-mounting support for securing an object to a vertical surface and which is simple in construction and low in cost.

It is a further object of the instant invention to provide a support for readily mounting a container or other similar object on a wall or other vertical surface.

It is still a further of the instant invention to provide a bracket for readily mounting a shelf on a wall or other vertical surface.

These and other objects of the instant invention are achieved by providing a support for mounting an object on a vertically disposed wall portion having an exterior surface and an interior surface spaced from each other by a predetermined distance. The support comprises a body having a pair of ends. A leg projects perpendicular to the body from the first end and terminates in a piercing tip portion. The piercing tip portion lies in a plane parallel to the plane of the body. The leg portion is approximately equal in length to the distance separating the exterior and interior surfaces of the wall portion. The piercing tip portion is arranged to be extended through an opening in the wall portion connecting the surfaces so that when the support is rotated downward with respect to the wall portion, the piercing portion abuts the interior surface of the wall portion while the body of the support abuts the exterior surface and the leg portion rests on the wall portion contiguous with the opening.

In one embodiment, the support includes movable clamp means and a ledge for releasably mounting a container. In another embodiment, the support is in the form of a bracket for mounting a shelf on the wall portion.

Other objects and many of the attendant advantages of the instant invention will be readily appreciated as the same becomes better understood by reference to the following detailed description when considered in connection with the accompanying drawing wherein:

FIG. 1 is a perspective view of one embodiment of the support of the instant invention shown mounting a container, such as a plant pot on a wall surface.

FIG. 2 is a perspective view of the support shown in FIG. 1;

FIG. 3 is an enlarged sectional view taken along line 3—3 of FIG. 1;

FIG. 4 is a side elevational view, partially in section, showing a portion of the support of FIG. 1 during the mounting operation thereof;

FIG. 5 is an enlarged sectional view taken along line 5—5 of FIG. 2;

Figure 6:
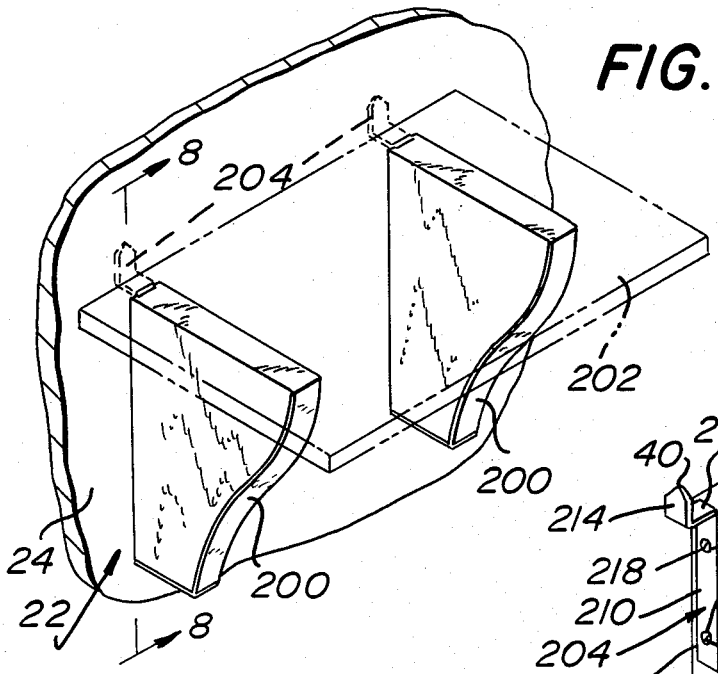
FIG. 6 is a perspective view of an alternative embodiment of the support of the instant invention shown mounting a shelf on a wall section.

Referring now to the various figures of the drawing wherein like reference characters refer to like parts, there is shown at 20 in FIG. 1 a wall support in accordance with one aspect of the instant invention and mounted on a conventional wall 22. The wall 22 can be of any type of hollow wall construction, such as gypsum board, plaster board, paneling, and other readily penetratable materials secured on studs. In such a construction, the material forming the wall includes an exterior surface 24 and an interior surface 26 spaced from each other by a predetermined distance, e.g., for gypsum board, $\frac{3}{8}$ inch (9.52 mm), $\frac{1}{2}$ inch (12.7 mm), $\frac{3}{4}$ inch (19.05 mm), etc.

As will be described in detail later, the supports of the instant invention are arranged to pierce through the body of the wall from the exterior surface to the interior surface to mount the support on the wall without the use of any additional fastening means, such as screws, bolts, anchors, etc.

In the embodiment shown in FIG. 1 the support 20 basically comprises a body portion 28, an intermediate leg portion 30, a piercing portion 32, a ledge portion 34 and movable clamping means 36.

The body portion 28, intermediate leg portion 30, piercing portion 32 and ledge portion 34 are formed as an integral unit from a relatively thin strip of material, e.g., steel, aluminum, plastic, etc. As can be seen in FIGS. 2 and 3, the body portion 28 is an elongated planar member having a pair of ends 38 and 40. The intermediate leg is a generally planar member including opposing first and second planar surfaces. The intermediate leg is connected to the body portion 28 at the first end 38 and extending generally perpendicularly to the plane of the body portion 28. The leg 30 terminates at its end in the piercing portion 32. The piercing portion 32 is generally planar including opposing first and second planar surfaces, and extends perpendicular to the plane of the leg portion 30 and parallel to the body portion 28. The piercing portion 32 is terminated at its free end in a point 42. The ledge 34 is a flange-like projection extending perpendicularly from the body portion 28 at the lower end 40 in the opposite direction to leg portion 30.

The support 20 is arranged so that when it is secured to the wall 22, its body portion 28 lies along the exterior surface 24 of the wall and with its ledge 34 projecting perpendicularly to the wall to form a horizontal support surface for an object, such as a conventional plant container or pot 44 (like shown in phantom lines in FIG. 1).

The movable clamping means 36 is provided to hold the pot or container 44 on the ledge. To that end, the movable clamping means basically comprises a sleeve element having a front portion 46 disposed over the front surface of the body portion and including a pair of ears 48 (FIG. 5) bent around the back surface of the body portion 28 to loosely encircle the body portion to enable the clamp 36 to be slid longitudinally therealong, that is, upward and downward along the body portion 28. The top edge of the front portion 46 of the sleeve is in the form of a hook 50 having a downwardly projecting free end 52 spaced from the sleeve's front to define a recess 54 (FIG. 3).

With the support 20 mounted on the wall 22 so that the body portion 28 extends along the vertical exterior surface 24 as shown in FIG. 3, the plant pot 44 is disposed so that its bottom surface 56 rests on the ledge 34. The clamping member 36 is then slid upward along the body portion 28 until the free end 52 clears the rim 58 of the sidewall 60 forming the pot 44. The pot is then slid towards the body portion 28 and the clamping member 36 is then slid downward, that is, toward the ledge 34, so that the rim 58 of the pot is located within the recess 54 of the clamp. This action securely locks the pot in place on the support 20.

The self-securement of the support 20 to the wall, without the need of any fastening means will be described in detail now. The support is grasped in one's hand and held so that the planar piercing portion 32 is horizontal. The point is then brought into contact with the exterior surface 24 of the wall 22 and pressure is applied to force the piercing portion through the wall as shown in FIG. 4 to form a horizontal opening or slit 62. Such action is readily accomplished when the wall is formed of readily penetratable material, such as gypsum board and the like. For paneling, or other more pierce resistant materials, it may be necessary to hammer the support through the material forming the wall section. For extremely hard materials, such as hardboard, it may be necessary to cut a slit in the material forming the wall section.

Once the piercing portion is extended fully through the wall so that the exterior surface 24 abuts the intermediate leg portion 30, the support 20 is rotated downward, that is, clockwise in the direction shown by the arrow in FIG. 4. This action causes the intermediate leg portion 30 of the support to extend through the slit 62 in the wall so that the exterior surface 64 of the piercing portion 32 abuts the interior surface 26 of the wall (as shown in FIG. 3), the interior surface 66 of the body portion 28 lies along the exterior surface 24 of the wall and with the intermediate leg 30 resting on the wall material contiguous with the slit 62. It is, of course, understood that in order for the portions of the support 20 to abut the wall section as described heretofore, the length of the intermediate leg portion 30 must be equal to the thickness of the wall section, that is, the distance between the exterior surface 24 and the interior surface 26.

It should thus be apparent that the support 20 of the instant invention can be readily secured to the wall by a simple mechanical manipulation and without the need for separate fastening means, such as, screws, bolts, etc. Moreover, when it is desired to remove the support from the wall, all that is necessary is to rotate the support upward, that is, in the opposite direction to that of the arrow shown in FIG. 4 until the piercing portion is oriented as shown in FIG. 4 at which time the support is retracted from the wall.

In FIG. 6, there is shown a pair of brackets 200, each constructed in accordance with the instant invention for mounting a conventional shelf 202 on the wall 22, like described heretofore. Each of the brackets 200 is identical construction and basically comprises a support block 202 and a support 204. The block 202 is of generally conventional construction and includes a vertical, planar side surface 206 adapted to fit against the exterior surface 24 of the wall 22 and a horizontal planar top surface 209 adapted to support the shelf 202 directly thereon. The block 204 includes a vertically extending slot 208 in its vertical surface 206 for receipt of a portion of the support 204 to enable the surface 206 to fit flush against the wall.

The support 204 is similar in construction in many respects to the support 20 of the embodiment shown in FIG. 1. To that end, the support 204 includes a planar body portion 210, a planar intermediate leg portion 212 and a planar piercing portion 214 formed as an integral unit from a relatively thin stip of material, like that used to form the support 20.

Figure 7:
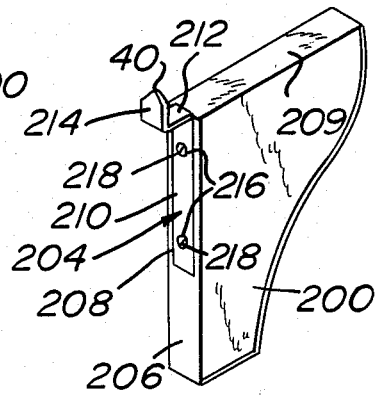
FIG. 7 is a perspective view of one of the brackets shown in FIG. 6.
Figure 8:
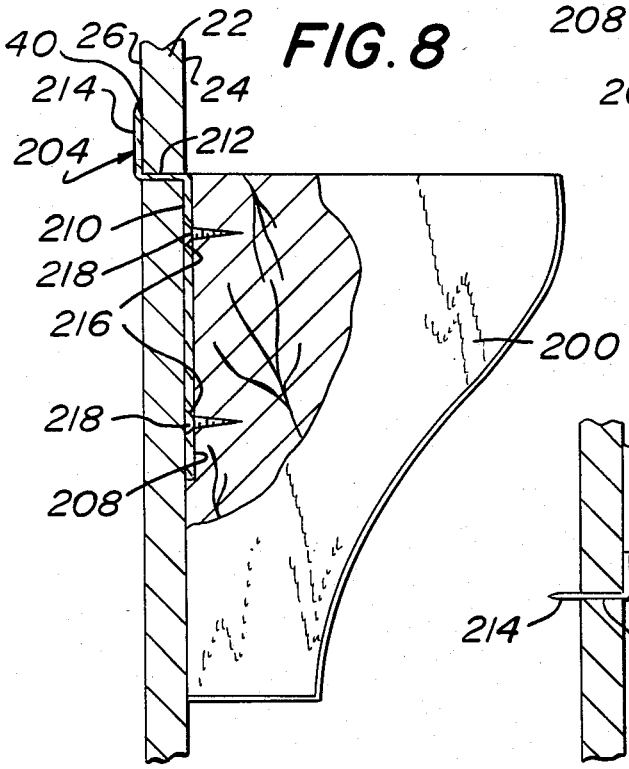
FIG. 8 is an enlarged sectional view taken along line 8—8 of FIG. 6.

As can be seen in FIGS. 7 and 8, the body portion 210 is an elongated member having a first end 216 from which the intermediate leg 212 projects normally. The piercing portion 214 is located at the end of intermediate leg 212 and extends perpendicular to the plane thereof and parallel to the plane of body portion 210. In this regard, the intermediate leg 212 and piercing portion 214 are identical in construction to intermediate leg 30 and piercing portion 32 of the support 20. The body portion 210 includes a pair of openings 216 adapted to receive respective threaded fastening members or screws 218 for insertion into the block 202 to secure the support to the block with the body portion 210 located within the vertically extending slot 208. When the support 208 is secured to the block 204, the top surface of the leg portion 212 is flush with the top surface 210 of the block while the exposed surface of the body portion 210 is flush with the vertical surface 206 of the block.

Figure 9:
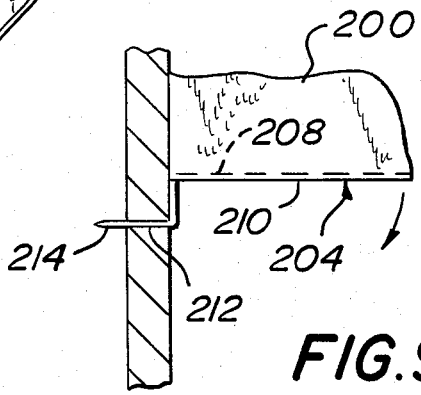
FIG. 9 is a side elevational view, partially in section, showing a portion of the support of FIG. 6 during the mounting operation thereof.

The mounting of the bracket 200 on the wall 22 is as follows: The bracket is held so that the piercing portion 214 is horizontal, as shown in FIG. 9. The pointed end of the piercing portion is then brought into contact with the exterior surface 24 of the wall section and pressure is applied to force the piercing portion through the wall as shown in FIG. 9. The bracket is then rotated downward, that is, counter clockwise in the direction of the arrow 220 to cause the interior surface of piercing portion 214 to abut the interior surface 26 of the wall while the exposed surface of the body portion 210 and the contiguous vertical surface 206 of the block 204 abut and lie along the exterior surface 24 of the wall and with the intermediate leg portion 212 resting on the material of the wall contiguous with the slit formed by the piercing action of the piercing portion 214.

As will be appreciated from the foregoing, the supports of the instant invention are simple in construction and enables one to readily mount them on a wall without the use of any additional fastening means. Once mounted, the supports are quite resistant to accidental displacement by the application of downward force thereon. Thus, the supports form a secure mount for various objects, such as plant pots or other containers, shelves, etc. Moreover, when it is desired to remove the supports, such action can be readily accomplished by reversing the procedure used for mounting the supports on the wall.

Without further elaboration, the foregoing will so fully illustrate my invention that others may, by applying current or future knowlege, readily adapt the same for use under various conditions of service.

What is claimed as the invention is:

1. A support for mounting an object on a vertically disposed wall portion having an exterior surface and an interior surface spaced from each other by a predetermined distance, said support comprising body means, leg means and internal support means, said body means being an elongated planar member having a first and second end, said leg means and said internal support means each including opposing first and second planar surfaces, wherein said leg means is approximately equal in length to said predetermined distance and being connected to the first end of said body means perpendicularly to the plane thereof, said internal support means comprising sharp pointed piercing means which is connected to said leg portion parallel to the plane of said body means and arranged to pierce extended through an opening in said wall portion connecting said surfaces, whereupon, when said support is rotated downward with respect to said wall portion a first planar surface of said internal support means abuts said interior surface of said wall portion, with said body portion abutting said exterior surface and said second planar surface of said leg portion disposed horizontally and resting on the wall portion contiguous with said opening.

2. The support of claim 1 wherein said body means, leg means and piercing means are formed as an integral unit.

3. The support of claim 2 additionally comprising ledge means connected to said body means at the second end thereof.

4. The support of claim 3 wherein said ledge means comprises a member extending generally perpendicularly to the plane of said body means.

5. The support of claim 4 additionally comprising clamping means slidably mounted on said body means.

6. The support of claim 5 wherein said clamping means comprises a downwardly extending finger spaced from said body means and adapted to engage the rim of a container disposed on said ledge means.

7. The support of claim 2 additionally comprising mounting means on said body portion for mounting a bracket thereon.

8. The support of claim 7 wherein said mounting means comprise a pair of apertures for receipt of fastening means extending into said bracket.

9. The support of claim 8 wherein said bracket includes a vertical surface adapted to fit flush against the exterior surface of said wall portion and having an elongated recess therein for receipt of said body portion.

* * * * *